United States Patent [19]

Salerno

[11] 4,165,553

[45] Aug. 28, 1979

[54] SLIDING DOOR SAFETY DEVICE

[76] Inventor: Michael T. Salerno, 47 Walton Ave., Oakland, N.J. 07436

[21] Appl. No.: 874,344

[22] Filed: Feb. 1, 1978

[51] Int. Cl.[2] ..... E05D 13/00

[52] U.S. Cl. ..... 16/86 A; 49/70; 49/404; 109/63.5

[58] Field of Search ..... 49/383, 460, 404, 462, 49/370, 366, 26, 70; 16/82, 86 R, 86 A, 83, 49; 109/73, 64, 63.5, 63, 61, 62, 59; 292/252, 238, DIG. 46, 304, 343

[56] References Cited

U.S. PATENT DOCUMENTS

| | | | |
|---|---|---|---|
| 896,242 | 8/1908 | Ralston | 16/86 A UX |
| 3,200,434 | 8/1965 | Jarnot | 16/86 A |
| 3,335,453 | 8/1967 | Lovelace | 16/82 |

*Primary Examiner*—Philip C. Kannan
*Attorney, Agent, or Firm*—Daniel Jay Tick

[57] ABSTRACT

A support device pivotally supports a resilient body on the leading surface of a sliding door frame in a manner whereby the gravitational force on the body moves the body between a sliding door and the frame. The body is manually movable away from the door and the frame, so that the body is positioned by gravitational force in abutment with the leading surface of the door when the door is closed. This permits the door to be securely closed with its leading edge in abutment with the frame. The body is interposed by gravitational force between the leading edge of the door and the frame when the door is open thereby preventing the door from closing fully by preventing the leading edge of the door from abutting the frame and thus protecting hands from being crushed between the door and the frame.

2 Claims, 5 Drawing Figures

FIG. 2
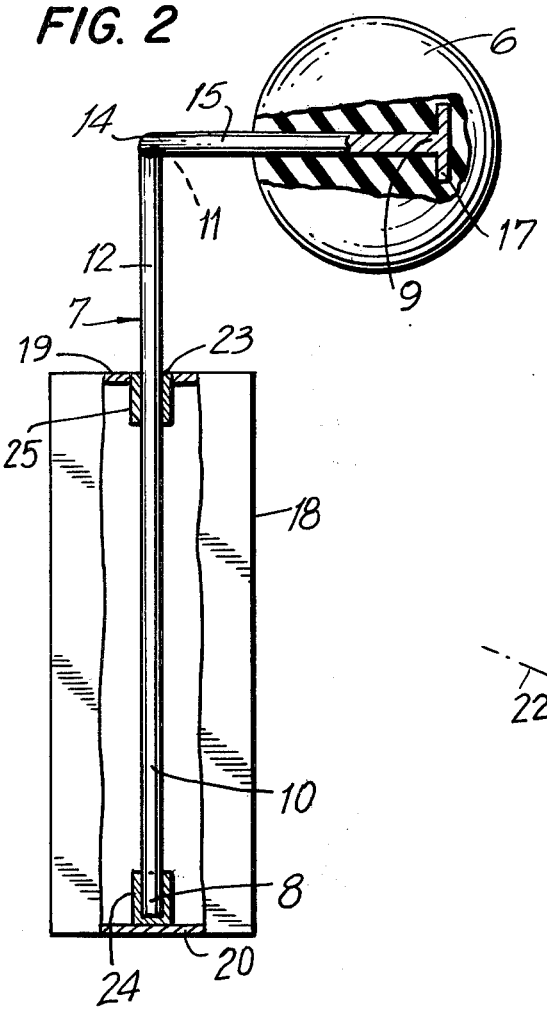
FIG. 4
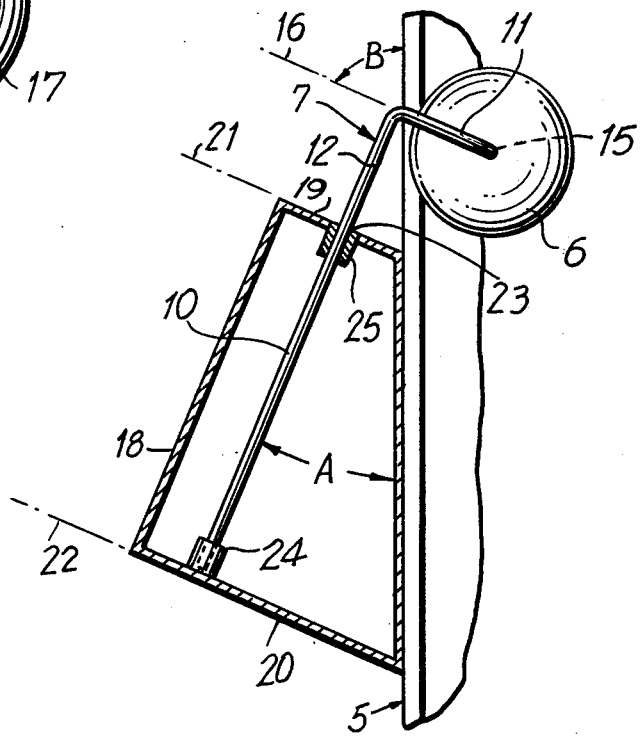
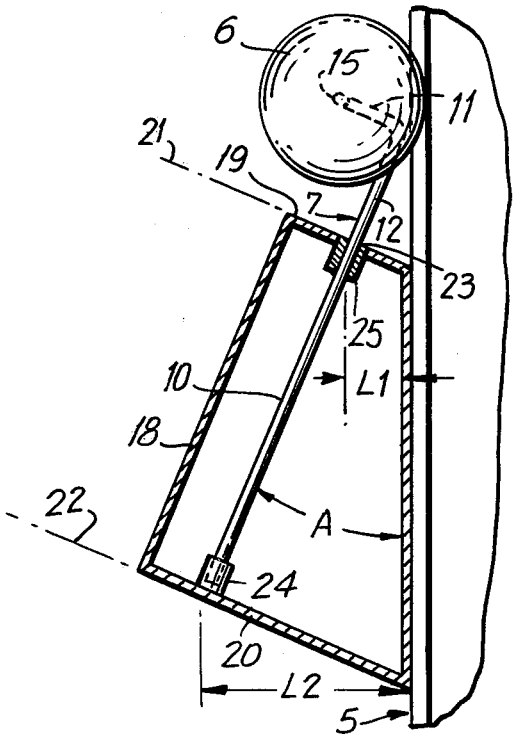
FIG. 5

SLIDING DOOR SAFETY DEVICE

BACKGROUND OF THE INVENTION

The present invention relates to a sliding door safety device. More particularly, the invention relates to a sliding door safety device for a sliding door slidably mounted in a door frame having a track slidably accommodating the door.

People, and especially children, are often injured when they have a hand caught between a sliding door and its frame when someone else pushes the door closed and is not aware of the dangerous position of the hand.

The principal object of the invention is to provide a sliding door safety device for preventing the fingers of unsuspecting people, and expecially children, from being crushed between the door and the frame of a sliding door when the door is suddenly closed.

An object of the invention is to provide a sliding door safety device for preventing injury to people's hands when a sliding door is suddenly closed, which device is of simple structure and installable with facility and convenience for use with newly installed and old doors.

Another object of the invention is to provide a sliding door safety device which is inexpensive in manufacture and functions efficiently, effectively and reliably to prevent a sliding door from closing fully, thereby preventing the hand of an unsuspecting person from being crushed between the door and its frame when the door is suddenly closed.

BRIEF SUMMARY OF THE INVENTION

In accordance with the invention, a sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, comprises a resilient body. A support device pivotally supports the resilient body on the leading surface of the frame in a manner whereby the gravitational force on the body moves the body between the door and the frame. The body is manually movable away from the door and the frame, so that the body is positioned by gravitational force in abutment with the leading surface of the door when the door is closed thereby permitting the door to be securely closed with its leading edge in abutment with the frame. The body is interposed by gravitational force between the leading edge of the door and the frame when the door is open thereby preventing the door from closing fully by preventing the leading edge of the door from abutting the frame and thus protecting hands from being crushed between the door and the frame.

The support device comprises a rod having spaced opposite first and second ends. The rod has a linear part extending for most of its length from the first end and is bent in the area of its second end in a manner whereby the second end is spaced at a substantially radial distance from the linear part. The body is mounted on the second end of the rod. A mounting device pivotally mounts the rod at an acute angle with the leading surface of the frame in a manner whereby the body is rotatable in an operating plane perpendicular to the linear part and at an acute angle with the leading surface of the frame.

The mounting device comprises a housing affixed to the leading surface of the frame and having spaced substantially parallel top and bottom parts extending in planes spaced below and substantially parallel to the operating plane. The top part has a hole formed therethrough. First and second bushings are mounted at the bottom and top parts, respectively, for pivotally accommodating the rod with the first end of the rod in the first bushing and the rod passing through the second bushing and the hole in the area of the end of the linear part adjacent its bent area. The second bushing is positioned at the hole. The linear part of the rod is in the housing and the bent area of the rod is outside of the housing.

The body comprises a ball.

The second bushing is spaced a predetermined distance from the leading surface of the frame and the first bushing is spaced at least four times the predetermined distance from the leading surface of the frame.

The rod is bent in the area of its second end at substantially right angles with the linear part to form a first arm extending from the end of the linear part adjacent the bent area. The first arm and the linear part form a first support plane. The rod is bent again at the end of the first arm farthest from the linear part at substantially right angles with the first arm to form a second arm extending from the end of the first arm. The first and second arms form the operating plane perpendicular to the first support plane and to the linear part.

BRIEF DESCRIPTION OF THE DRAWINGS

In order that the invention may be readily carried into effect, it will now be described with reference to the accompanying drawings, wherein:

FIG. 2 is a view, on an enlarged scale, partly cut away and partly in section, of the embodiment of FIG. 1;

FIG. 4 is a schematic diagram, partly in section, of the sliding door safety device of the invention in operative position; and FIG. 5 is a schematic diagram, partly in section, of the sliding door safety device of the invention in inoperative position.

DETAILED DESCRIPTION OF THE INVENTION

Figure 1:
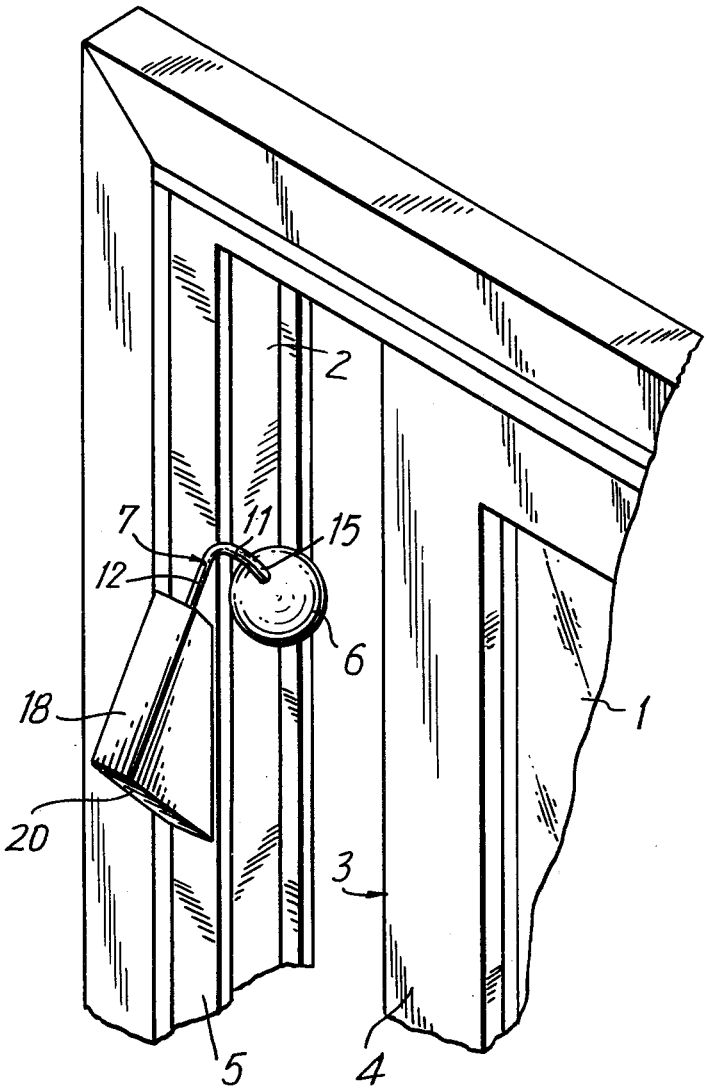
FIG. 1 is a perspective view of an embodiment of the sliding door safety device of the invention, mounted on a door frame and in operative position.

The sliding door safety device of the invention is for a sliding door 1 (FIG. 1) slidably mounted in a door frame 2 (FIG. 1) having a track (not shown in the FIGS.) slidably accommodating the door. The door 1 has a leading edge 3, which abuts the frame 2 when said door is closed, and a leading surface 4 in the area of said leading edge, as shown in FIG. 1. The frame 2 has a leading surface 5 (FIG. 1) which is next-adjacent the leading surface 4 of the door 1 when said door is closed.

The sliding door safety device of the invention comprises a resilient body or ball 6 (FIGS. 1 to 5) of any suitable material such as, for example, rubber.

A support device pivotally supports the resilient body 6 on the leading surface 5 of the frame 2 in a manner whereby the gravitational force on said body moves said body between the door 1 and said frame, as shown in FIG. 1. The body or ball 6 is manually movable away from the door 1 and the frame 2, so that said body is positioned by gravitational force in abutment with the leading surface 4 of said door when said door is closed, thereby permitting said door to be securely closed with its leading edge 3 in abutment with said frame.

The body 6 is interposed by gravitational force between the leading edge 3 of the door 1 and the frame 2 when said door is open, as shown in FIG. 1, thereby preventing said door from closing fully by preventing said leading edge of said door from abutting said frame and thus protecting hands from being crushed between said door and said frame.

The support device comprises a rod 7 (FIGS. 1 to 5) having spaced opposite first and second ends 8 and 9, respectively, as shown in FIG. 2. The rod 7 has a linear part 10 (FIGS. 2, 4 and 5) extending for most of its length from the first end 8 thereof. The rod 7 is bent in the area of its second end 9 in a manner whereby said second end is spaced at a substantially radial distance from the linear part 10.

Figure 3:
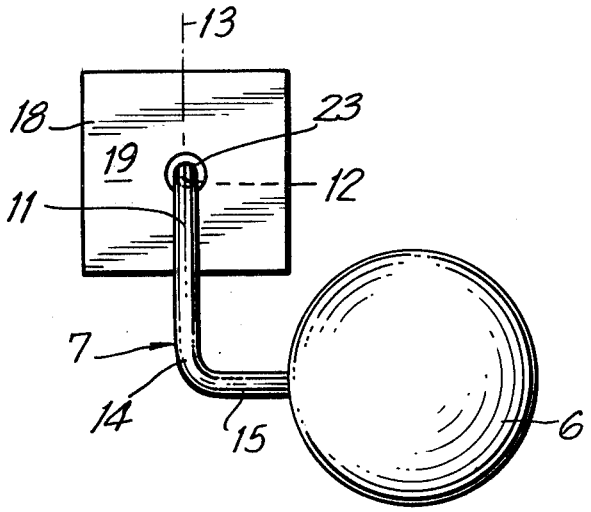
FIG. 3 is a top view of the embodiment of FIG. 1.

The rod 7 is bent in the area of its second end 9 at substantially right angles with the linear part 10 of said rod to form a first arm 11 extending from the end 12 of said linear part adjacent the bent area, as shown in FIGS. 2 to 4. The first arm 11 and the linear part 10 forms a first support plane 13 (FIG. 3). The rod 7 is bent again at the end 14 of the first arm 11 farthest from the linear part 10 at substantially right angles with said first arm, as shown in FIGS. 2 and 3, to form a second arm 15 extending from said end of said first arm, as shown in FIGS. 1, 2 and 3. The first and second arms 11 and 15 form an operating plane 16 (FIG. 4) perpendicular to the first support plane 13 and to the linear part 10. The operating plane 16 is further described hereinafter.

The resilient body 6 is mounted on the second end 9 of the rod 7 by any suitable device such as, for example, a collar 17 (FIG. 2) on said second end for retaining said body on said rod. The body 6 may be fixedly or rotatably mounted on the rod 7. The body 6 may be mounted on the rod 7 by being impaled thereon.

A mounting device pivotally mounts the rod 7 at an acute angle A with the leading surface 5 of the frame 2, as shown in FIGS. 4 and 5, in a manner whereby the body 6 is rotatable in the operating plane 16. The operating plane 16 is at an acute angle B with the leading surface 5 of the frame 2, as shown in FIG. 4.

The mounting device comprises a housing 18 (FIGS. 1 to 5) affixed to the leading surface 5 of the frame 2, as shown in FIGS. 1, 4 and 5. The housing 18 has spaced substantially parallel top and bottom parts 19 and 20, respectively, extending in planes 21 and 22, respectively, spaced below and substantially parallel to the operating plane 16, as shown in FIGS. 4 and 5. The top part 19 of the housing 18 has a hole 23 (FIGS. 2 to 5) formed therethrough.

First and second bushings 24 and 25, respectively, are mounted at the bottom and top parts 20 and 19, respectively (FIGS. 2, 4 and 5). The bushings 24 and 25 pivotally accommodate the rod 7 with the first end 8 of said rod in the first bushing, and said rod passing through the second bushing and the hole 23. The rod 7 passes through the second bushing 25 in the area of the end 12 of the linear part 10 adjacent the bent area, as shown in FIGS. 2 and 4. The linear part 10 of the rod 7 is in the housing 18 and the bent area of said rod is outside of said housing (FIGS. 1 to 5).

The second bushing 25 is positioned coaxially in the hole 23, as shown in FIGS. 2, 4 and 5, and is spaced a predetermined distance L1 from the leading surface 5 of the frame 2, as shown in FIG. 5. The first bushing 24 is spaced a distance L2, which is at least four times the distance L1, from the leading surface 5 of the frame 2 (FIG. 5).

While the invention has been described by means of a specific example and in a specific embodiment, I do not wish to be limited thereto, for obvious modifications will occur to those skilled in the art without departing from the spirit and scope of the invention.

I claim:

1. A sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, said sliding door safety device comprising a resilient ball; and support means pivotally supporting the resilient ball on the leading surface of the frame in a manner whereby the gravitational force on said ball moves said ball between the door and the frame, said ball being manually movable away from said door and said frame, so that said ball is positioned by gravitational force in abutment with the leading surface of said door when said door is closed thereby permitting said door to be securely closed with its leading edge in abutment with said frame, and is interposed by gravitational force between said leading edge of said door and said frame when said door is open thereby preventing the door from closing fully by preventing said leading edge of said door from abutting said frame and thus protecting hands from being crushed between said door and said frame, said support means comprising a rod having spaced opposite first and second ends, said rod having a linear part extending for most of its length from the first end and being bent in the area of its second end in a manner whereby said second end is spaced at a substantially radial distance from said linear part, said ball being mounted on the second end of said rod, and mounting means for pivotally mounting said rod at an acute angle with said leading surface of said frame in a manner whereby said ball is rotatable in an operating plane perpendicular to said linear part and at an acute angle with said leading surface of said frame, said mounting means comprising a housing affixed to said leading surface of said frame and having spaced substantially parallel top and bottom parts extending in planes spaced below and substantially parallel to the operating plane, said top part having a hole formed therethrough, and first and second bushings mounted at said bottom and top parts, respectively, for pivotally accommodating said rod with the first end of said rod in said first bushing and said rod passing through said second bushing and said hole in the area of the end of said linear part adjacent its bent area, said second bushing being positioned at said hole and said linear part of said rod being in said housing and the bent area of said rod being outside of said housing, said second bushing being spaced a predetermined distance from said leading surface of said frame and said first bushing being spaced at least four times said predetermined distance from said leading surface of said frame.

2. A sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, said sliding door safety device comprising a resilient ball; and support means pivotally supporting the resilient ball on the leading surface of the frame in a manner whereby the gravitational force on said ball moves said ball between the door and the frame, said ball being manually movable away from said door and said frame, so that said ball is positioned by gravitational force in abutment with the leading surface of said door when said door is closed thereby permitting said door to be securely closed with its leading edge in abutment with said frame, and is interposed by gravitational force between said leading edge of said door and said frame when said door is open thereby preventing the door from closing fully by preventing said leading edge of said door from abutting said frame and thus protecting hands from being crushed between said door and said frame, said support means comprising a rod having spaced opposite first and second ends, said rod having a linear part extending for most of its length from the first end and being bent in the area of its second end in a manner whereby said second end is spaced at a substantially radial distance from said linear part, said rod being bent in the area of its second end at substantially right angles with said linear part to form a first arm extending from the end of said linear part adjacent said bent area, said first arm and said linear part forming a first support plane, and said rod being bent again at the end of said first arm farthest from said linear part at substantially right angles with said first arm to form a second arm extending from said end of said first arm, said first and second arms forming said operating plane perpendicular to said first support plane and to said linear part, said ball being mounted on the second end of said rod, and mounting means for pivotally mounting said rod at an acute angle with said leading surface of said frame in a manner whereby said ball is rotatable in an operating plane perpendicular to said linear part and at an acute angle with said leading surface of said frame, said mounting means comprising a housing affixed to said leading surface of said frame and having spaced substantially parallel top and bottom parts extending in planes spaced below and substantially parallel to the operating plane, said top part having a hole formed therethrough, and first and second bushings mounted at said bottom and top parts, respectively, for pivotally accommodating said rod with the first end of said rod in said first bushing and said rod passing through said second bushing and said hole in the area of the end of said linear part adjacent its bent area, said second bushing being positioned at said hole and said linear part of said rod being in said housing and the bent area of said rod being outside of said housing.

* * * * *